US009213283B2

(12) United States Patent
Furukata et al.

(10) Patent No.: US 9,213,283 B2
(45) Date of Patent: Dec. 15, 2015

(54) FIXING DEVICE, AND IMAGE FORMING APPARATUS

(71) Applicant: FUJI XEROX CO., LTD., Minato-ku, Tokyo (JP)

(72) Inventors: Hiroko Furukata, Kanagawa (JP); Shigeru Watanabe, Kanagawa (JP); Yasutaka Goto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/262,236

(22) Filed: Apr. 25, 2014

(65) Prior Publication Data

US 2015/0098736 A1 Apr. 9, 2015

(30) Foreign Application Priority Data

Oct. 8, 2013 (JP) ..... 2013-210649

(51) Int. Cl.
*G03G 15/20* (2006.01)

(52) U.S. Cl.
CPC ..... *G03G 15/2064* (2013.01); *G03G 15/2032* (2013.01); *G03G 15/2067* (2013.01)

(58) Field of Classification Search
CPC ..... G03G 15/2032; G03G 15/2035; G03G 15/2067; G03G 15/2071; G03G 2215/2009
USPC ..... 399/21, 328, 329
See application file for complete search history.

(56) References Cited

U.S. PATENT DOCUMENTS

2009/0226227 A1 9/2009 Furukata et al.

FOREIGN PATENT DOCUMENTS

JP 2002148984 A * 5/2002
JP 2009-216911 A 9/2009

OTHER PUBLICATIONS

Nishida (JP 2002-148984 A), May 2002, JPO Computer Translation.*

* cited by examiner

*Primary Examiner* — Erika J Villaluna
(74) *Attorney, Agent, or Firm* — Sughrue Mion, PLLC

(57) ABSTRACT

Provided is a fixing device including a heating rotating body that heats a toner image formed on a recording medium, a pressurizing rotating body including an endless belt that is placed in such a manner that an outer circumferential surface thereof faces the heating rotating body, a first pressurizing member that is placed on a side of an inner circumferential surface of the endless belt and forms a fixing nip portion between the endless belt and the heating rotating body, and a second pressurizing member that guides the recording medium so that the recording medium comes into contact with the heating rotating body on an upstream side of the fixing nip portion in a transportation direction of the recording medium, and a releasing unit that releases pressure contact of the pressurizing rotating body that is in pressure contact with heating rotating body.

9 Claims, 7 Drawing Sheets

FIXING DEVICE, AND IMAGE FORMING APPARATUS

CROSS-REFERENCE TO RELATED APPLICATIONS

This application is based on and claims priority under 35 USC 119 from Japanese Patent Application No. 2013-210649 filed Oct. 8, 2013.

BACKGROUND

Technical Field

The present invention relates to a fixing device, and an image forming apparatus.

SUMMARY

According to an aspect of the invention, there is provided a fixing device including:

a heating rotating body that heats a toner image formed on a recording medium;

a pressurizing rotating body including:

an endless belt that is placed in such a manner that an outer circumferential surface thereof faces the heating rotating body;

a first pressurizing member that is placed on a side of an inner circumferential surface of the endless belt and forms a fixing nip portion between the endless belt and the heating rotating body by pressing the outer circumferential surface of the endless belt to the heating rotating body; and a second pressurizing member that guides the recording medium so that the recording medium comes into contact with the heating rotating body on an upstream side of the fixing nip portion in a transportation direction of the recording medium by pressing the endless belt to the heating rotating body on the upstream side of the fixing nip portion of the side of the inner circumferential surface of the endless belt in the transportation direction of the recording medium; and a releasing unit that releases pressure contact of the pressurizing rotating body that is in pressure contact with heating rotating body, wherein the second pressurizing member is movably supported in a opposite direction opposite to a direction in which the second pressurizing member presses the pressurizing rotating body when the pressure contact of the pressurizing rotating body is released by the releasing unit.

BRIEF DESCRIPTION OF THE DRAWINGS

Exemplary embodiments of the present invention will be described in detail based on the following figures, wherein.

DETAILED DESCRIPTION

Figure 1:
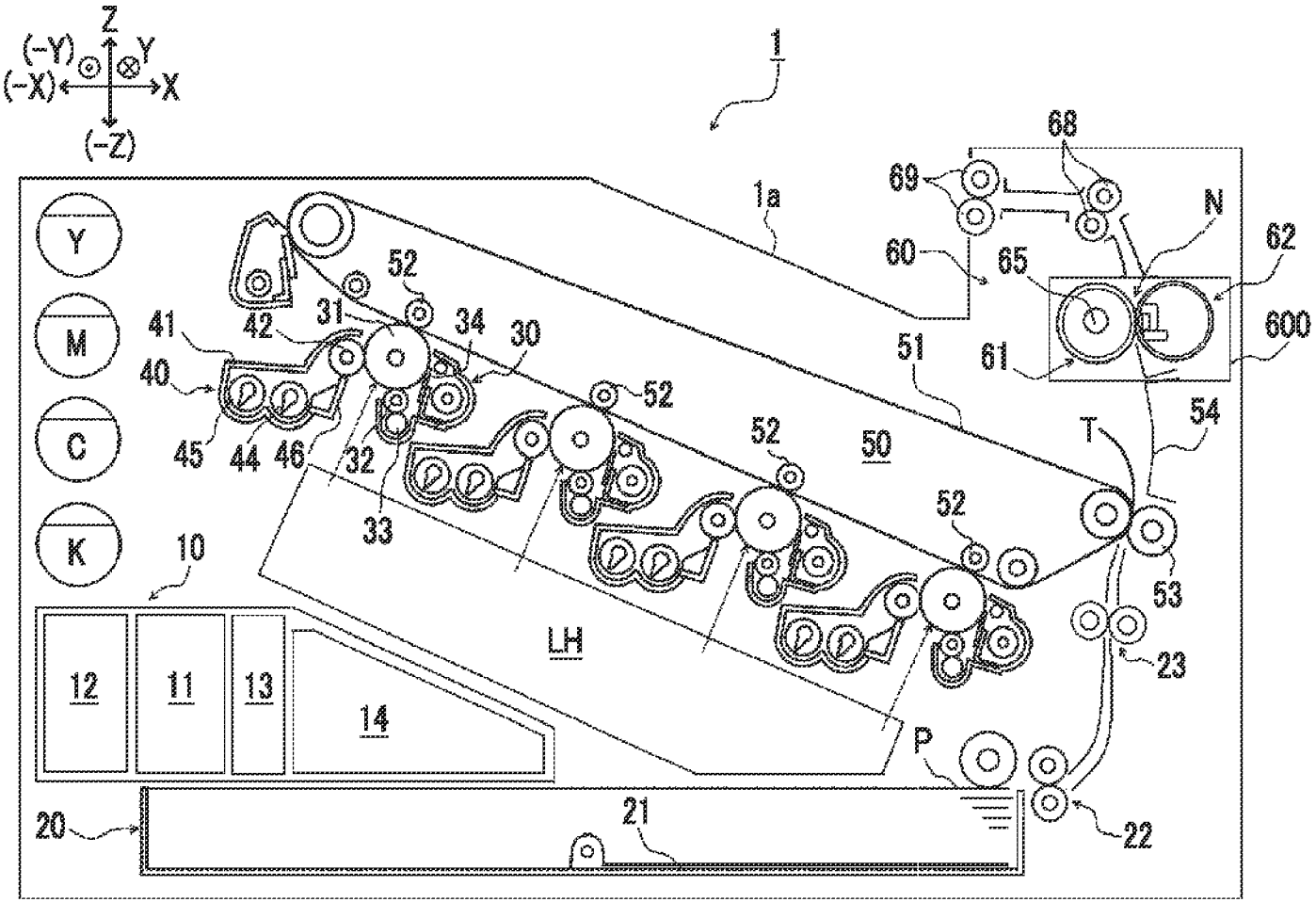
FIG. 1 is a sectional schematic diagram illustrating an internal configuration of an image forming apparatus.

Next, hereinafter, an embodiment and a specific example are given and the invention is described in more detail with reference to the drawings, but the invention is not limited to the embodiment and the specific example.

Further, in the following description with reference to the drawings, the drawings are schematically illustrated and it should be noted that a ratio and the like of each dimension is different from in reality, and, for the sake of easy understanding, illustrations of members other than those which are necessary for the description are appropriately omitted.

Further, for the sake of easy understanding of the following description, in the drawings, a longitudinal direction is referred to as an X axis direction, a lateral direction is referred to as a Y axis direction, and a vertical direction is referred to as a Z axis direction.

(1) Entire Configuration and Operation of Image Forming Apparatus

FIG. 1 is a sectional schematic diagram illustrating an internal configuration of an image forming apparatus 1 according to the embodiment.

Hereinafter, an entire configuration and operation of the image forming apparatus 1 are described with reference to the drawings.

(1.1) System Configuration of Image Forming Apparatus

The image forming apparatus 1 includes a control device 10, a sheet feeding device 20, a photoconductor unit 30, a developing device 40, a transfer device 50, and a fixing device 60. An output tray 1*a* that outputs and stores a sheet on which an image is recorded is formed on an upper surface (the Z direction) of the image forming apparatus 1.

The control device 10 includes an image forming apparatus control portion 11 that controls the operation of the image forming apparatus 1, a controller portion 12 that prepares image data depending on a print processing request, an exposure control portion 13 that controls lighting of an exposure device LH, a power supply device 14 and the like. The power supply device 14 applies a voltage to a charging roller 32, a developing roller 42, a primary image transfer roller 52, a secondary image transfer roller 53 and the like described below, and supplies power to the exposure device LH.

The controller portion 12 outputs a drive signal to the exposure device LH by converting print information input from an external information transmission device (for example, personal computer or the like) into image information for forming a latent image at timing that is set in advance.

(1.2) Configuration and Operation of Image Forming Portion

The sheet feeding device 20 is provided in a bottom portion of the image forming apparatus 1. The sheet feeding device 20 includes a sheet loading plate 21 and plural sheets P as recording media are loaded on an upper surface of the sheet loading plate 21. The sheet P which is loaded on the sheet loading plate 21 and of which a position in a width direction is determined in a regulating plate (not illustrated) is transported to a nip portion of a pair of resist rollers 23 after the sheet P is drawn laterally (X direction) from an upper side by a sheet drawing portion 22 one by one.

Each photoconductor unit 30 is provided on the upper side (Z direction) of the sheet feeding device 20 in parallel and includes a photoconductor drum 31 as an image holding member that is rotatably driven. The charging roller 32, the exposure device LH, the developing device 40, the primary image transfer roller 52 and a cleaning blade 34 are placed in a rotation direction of the photoconductor drum 31. A cleaning roller 33 that cleans a surface of the charging roller 32 is placed to face and be in contact with the charging roller 32.

The developing device 40 includes a developing housing 41 that stores developer on the inside thereof. The developing roller 42 that is placed by facing the photoconductor drum 31 and a pair of augers 44 and 45 that agitates and transports the developer to the side of the developing roller 42 on an obliquely lower side of a back surface of the developing roller 42 are placed inside the developing housing 41. A layer regulating member 46 that regulates a layer thickness of the developer is placed close to the developing roller 42.

Each of the developing devices 40 has the same configuration as each other excepts the developer stored in the developing housing 41 and forms toner images of yellow (Y), magenta (M), cyan (C) and black (K), respectively.

A surface of the photoconductor drum 31 that rotates is charged by the charging roller 32 and an electrostatic latent image is formed by a latent image forming light emitted from the exposure device LH. The electrostatic latent image formed on the photoconductor drum 31 is developed by the developing roller 42 as the toner image.

The transfer device 50 includes an intermediate image transfer belt 51 to which each color toner image formed on the photoconductor drum 31 of each photoconductor unit 30 is multi-transferred, and the primary image transfer roller 52 which sequentially transfers (primary image transfer) each color toner image formed on each photoconductor unit 30 to the intermediate image transfer belt 51. Further, the transfer device 50 includes the secondary image transfer roller 53 which collectively transfers (secondary image transfer) each color toner image superimposed and transferred onto the intermediate image transfer belt 51 onto the sheet P that is a recording medium.

Each color toner image formed on the photoconductor drum of each photoconductor unit 30 is sequentially electrostatically transferred (primary image transfer) on the intermediate image transfer belt 51 by the primary image transfer roller 52 to which a predetermined transfer voltage is applied from the power supply device 14 or the like controlled by the image forming apparatus control portion 11, and a superimposed toner image in which each color toner is superimposed is formed.

The superimposed toner image on the intermediate image transfer belt 51 is transported to a region (a secondary transfer portion T) in which the secondary image transfer roller 53 is placed according to the movement of the intermediate image transfer belt 51. When the superimposed toner image is transported to the secondary transfer portion T, the sheet P is supplied from the sheet feeding device 20 to the secondary transfer portion T according to the timing. Then, a predetermined transfer voltage is applied from the power supply device 14 or the like controlled by the image forming apparatus control portion 11 to the secondary image transfer roller 53, and the superimposed toner image on the intermediate image transfer belt 51 is collectively transferred onto the sheet P that is delivered from the pair of resist rollers 23 and guided by a transport guide.

Residual toner on the surface of the photoconductor drum 31 is removed by the cleaning blade 34 and is collected in a waste developer container. The surface of the photoconductor drum 31 is re-charged by the charging roller 32. Moreover, residual matter attached to the charging roller 32 which is not removed by the cleaning blade 34 is trapped on the surface of the cleaning roller 33 rotating by being in contact with the charging roller 32 and is accumulated.

The fixing device 60 includes a fixing unit 600, a pair of transfer rollers 68 and a pair of discharge rollers 69. The fixing unit 600 includes a heating module 61 and a pressurizing module 62, and a fixing region N (a fixing region) is formed by a pressure contact region of the heating module 61 and the pressurizing module 62.

The sheet P to which the toner image is transferred in the transfer device 50 is transported to the fixing device 60 through a transport guide 54 in a state where the toner image is not fixed. The toner image is fixed on the sheet P transported to the fixing device 60 with the functions of the pressure contact and heat by the pair of the heating module 61 and the pressurizing module 62.

The sheet P on which the fixed toner image is formed is discharged from the pair of discharge rollers 69 to the output tray 1*a* on the upper surface of the image forming apparatus 1 through the pair of transfer rollers 68.

(2) Configuration of Fixing Unit

Figure 2:
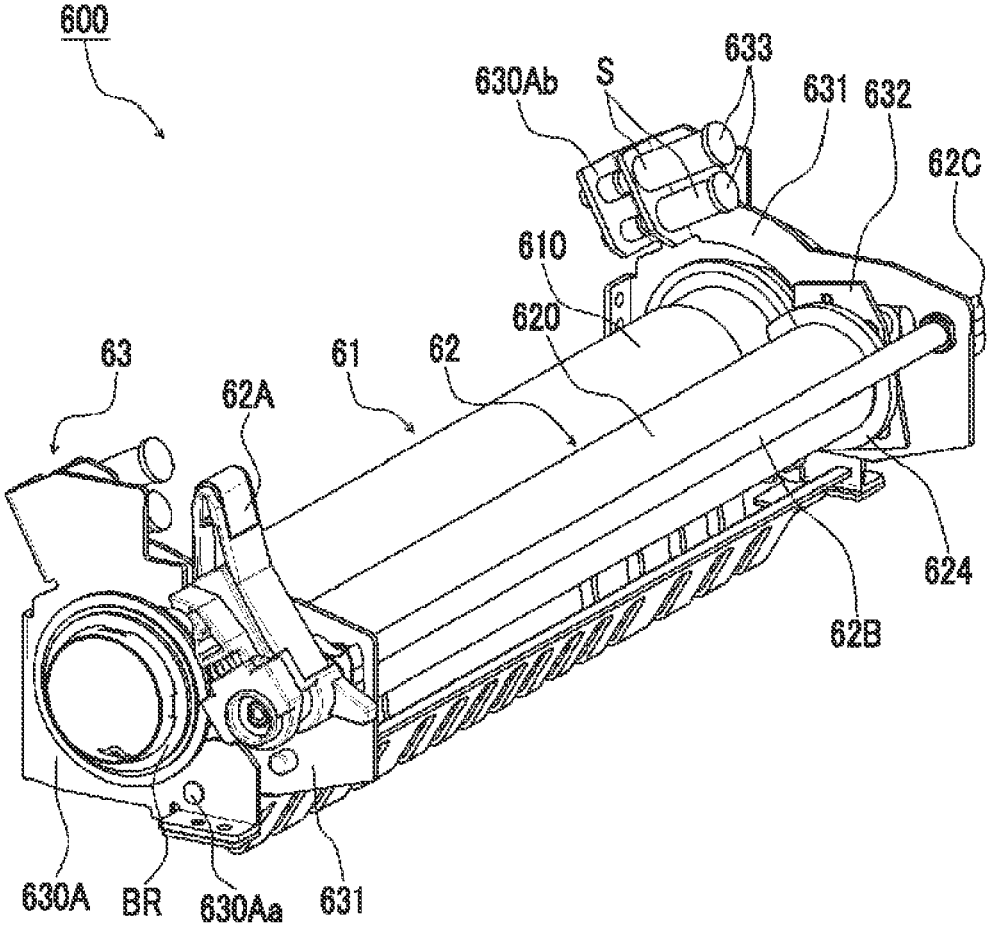
FIG. 2 is a perspective view illustrating an entire configuration of a fixing unit.
Figure 3:
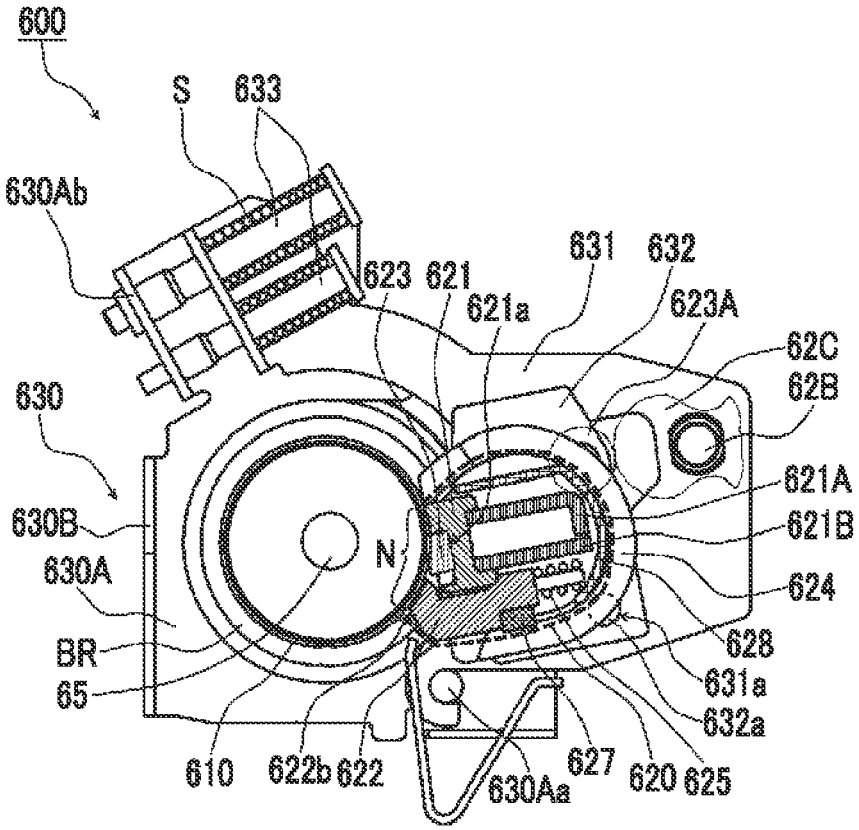
FIG. 3 is a sectional schematic diagram of the fixing unit.
Figure 4A:
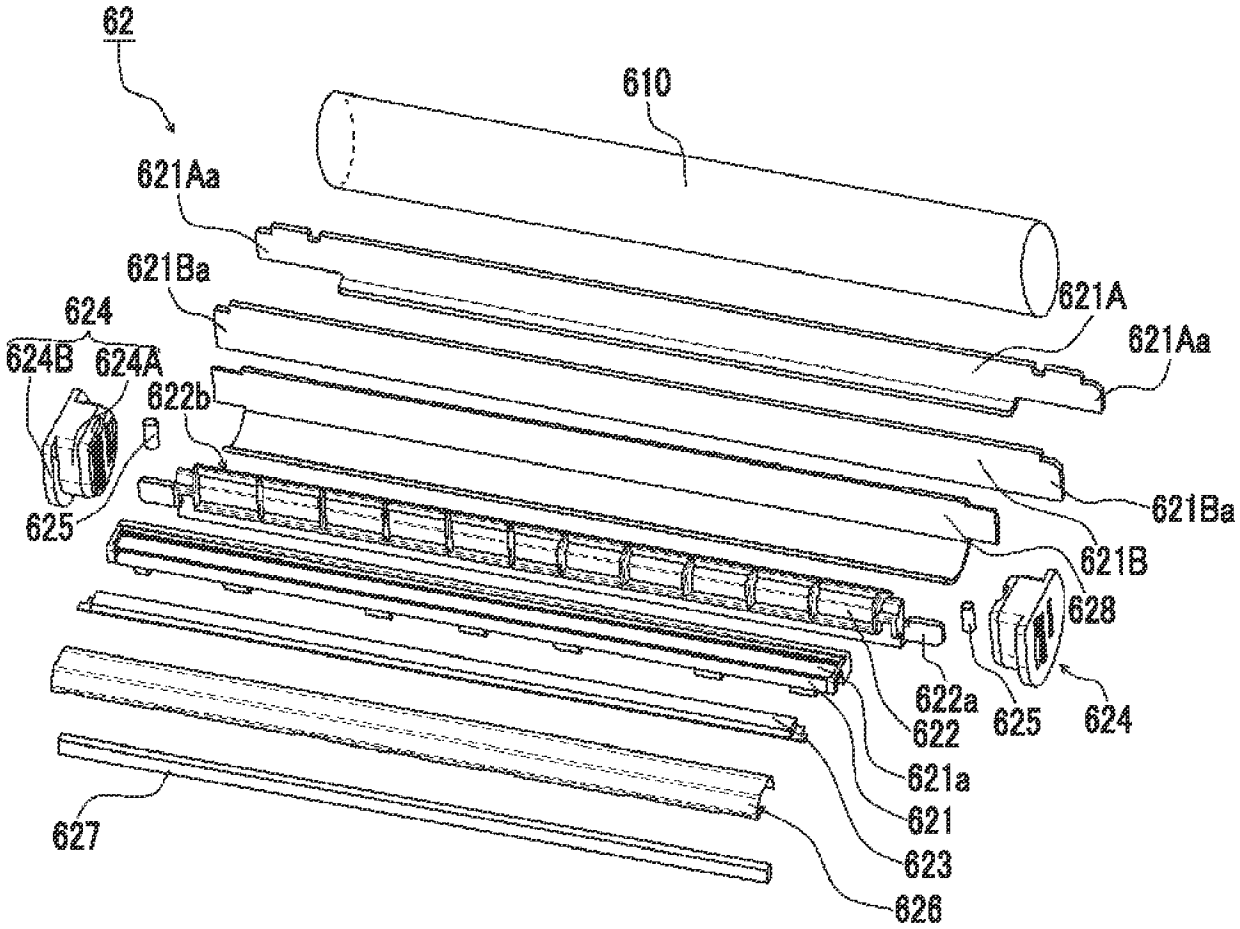
FIG. 4A is an exploded perspective view of a pressurizing module.
Figure 4B:
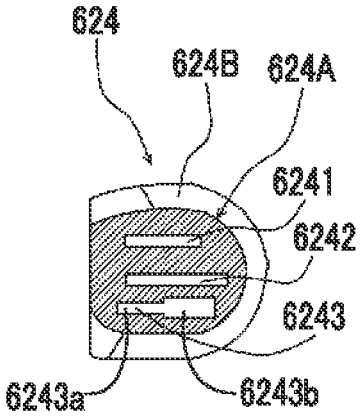
FIG. 4B is a cross-sectional view of a belt guide member.
Figure 5:
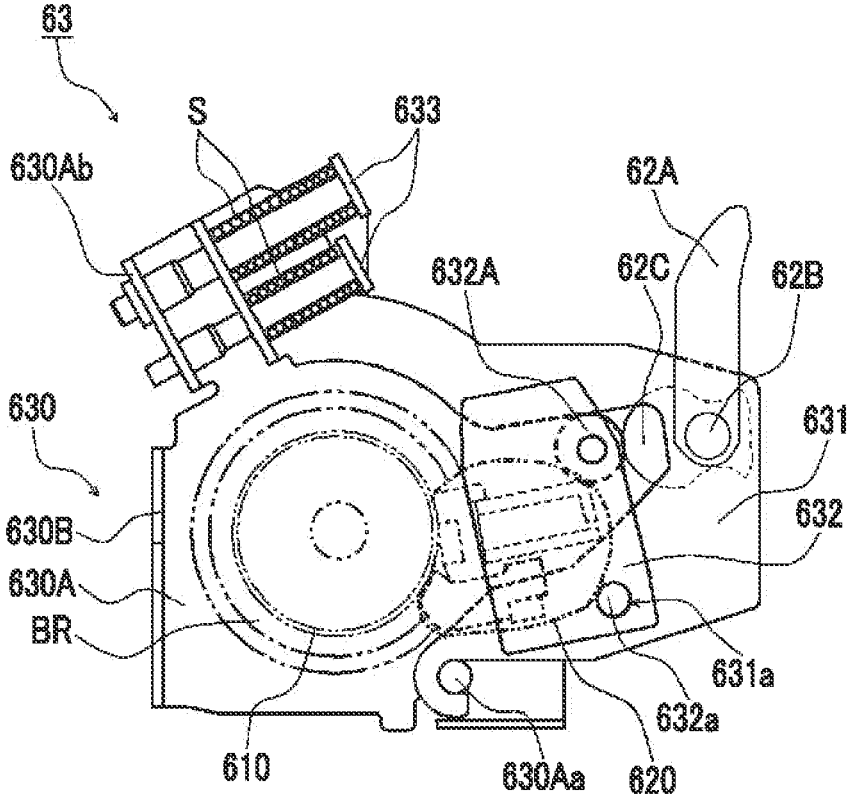
FIG. 5 is a sectional schematic diagram for describing a configuration of a support module.

FIG. 2 is a perspective view illustrating an entire configuration of the fixing unit 600, FIG. 3 is a sectional schematic diagram of the fixing unit 600, FIG. 4A is an exploded perspective view of the pressurizing module, FIG. 4B is a cross-sectional view of a belt guide member 624, and FIG. 5 is a sectional schematic diagram describing a configuration of a support module 63.

Hereinafter, the configuration of the fixing unit 600 is described with reference to the drawings.

(2.1) Entire Configuration of Fixing Unit

As illustrated in FIG. 2, in the fixing unit 600, the heating module 61, the pressurizing module 62 as a pressurizing rotating body, and the support module 63 that integrally supports the heating module 61 and the pressurizing module 62 are detachably with respect to the image forming apparatus 1 by being integrally formed.

The support module 63 includes an operation lever 62A that releases a pressurized state of the pressurizing module 62 with respect to the heating module 61.

(2.2) Heating Module

The heating module 61 includes a heating roller 610 as a heating rotating body that comes into contact with and heats the sheet P passing through the fixing region N, a fixing lamp 65 as a heating body that is placed inside the heating roller 610 having a gap with an inner circumferential surface of the heating roller 610, and a gear G (not illustrated) that rotates the heating roller 610 by receiving a rotational driving force from a driving portion (not illustrated) of the image forming apparatus 1.

The heating roller 610 is a cylindrical member of which both end portions are open and a base is a thin metal pipe, and which has a multilayer structure formed by overlapping an elastic layer formed of a silicon rubber and a release layer including a fluorine resin on an outer circumferential surface.

(2.3) Pressurizing Module

The pressurizing module 62 includes a pressurizing belt 620 as an endless belt, a first pressurizing member 621 and a second pressurizing member 622. The pressurizing belt 620 that is pressurized from the side of the inner circumferential surface by the first pressurizing member 621 and supported from the side of the inner circumferential surface by the second pressurizing member 622 forms the fixing region N in the contact portion with the heating roller 610.

The first pressurizing member 621 is placed on the side of the inner circumferential surface of the pressurizing belt 620 and pressurizes the pressurizing belt 620 by pressing the outer circumferential surface of the pressurizing belt 620 against the outer circumferential surface of the heating roller 610. Further, a recessed portion 621*a* that is open to the fixing region N is formed in the first pressurizing member 621, and a pad member 623 formed of a silicone rubber is fixed to the recessed portion 621*a*.

The second pressurizing member 622 is placed on the upstream side of the pressurizing belt 620 in the rotation direction on the side of the inner circumferential surface of the pressurizing belt 620, and supports the outer circumferential surface of the pressurizing belt 620 by protruding toward the outer circumferential surface of the heating roller 610.

Moreover, for example, the first pressurizing member 621 and the second pressurizing member 622 are formed of a synthetic resin having heat resistance such as polyethylene terephthalate (PET) and liquid crystal polymer (LCP).

As a result, in a portion in which the pressurizing belt 620 comes into contact with the heating roller 610, a region that is formed by the outer circumferential surface of the pressurizing belt 620 supported by the second pressurizing member 622 and a fixing nip portion that is formed by the outer circumferential surface of the pressurizing belt 620 pressurized by the pad member 623 and the first pressurizing member 621 form the fixing region N continuously along the transportation direction of the sheet P from the upstream side in the transportation direction of the sheet P.

As illustrated in FIG. 4A, the pressurizing belt 620 is a belt member having an endless shape of which both end portions are open, and has a multilayer structure in which a release layer including a fluorine resin such as polytetrafluoroethylene (PTFE) is formed on a surface of abase of the belt that is formed of a heat resistant resin such as polyimide (PI) in a thin cylindrical shape.

The inner circumferential surfaces of both end portions of the pressurizing belt 620 which are open are rotatably supported by a pair of belt guide members 624. Each belt guide member 624 includes a cylindrical circumferential wall 624A that is, for example, made of a synthetic resin having heat resistance such as polyethylene terephthalate (PET) and supports the inner circumferential surfaces of the both end portions of the pressurizing belt 620 and a flange portion 624B that regulates movement of the both end portions of the pressurizing belt 620 in the axial direction.

Further, as illustrated in FIG. 4B, each of through holes 6241, 6242 and 6243 is formed on the inside of the circumferential wall 624A of the belt guide member 624.

Both end portions 621Aa of a first pressurizing support member 621A that supports the first pressurizing member 621 from a side of a back surface on a side facing the pressurizing belt 620 are inserted through each through hole 6241 of the pair of belt guide members 624, and both end portions 621Ba of a second pressurizing support member 621B that supports the first pressurizing member 621 from the side of the back surface on the side facing the pressurizing belt 620 are inserted through and fixed to the through holes 6242.

Further, both end portions 622*a* of the second pressurizing member 622 are movably supported in the through holes 6243 in a direction facing the outer circumferential surface of the heating roller 610 by being inserted in a state of being supported by coil springs 625 as an example of an elastic member.

A slide sheet 626 that is a film member for sliding the pressurizing belt 620 is placed between the inner circumferential surface of the pressurizing belt 620, the first pressurizing member 621 and the pad member 623 in the fixing region N. For example, the slide sheet 626 is a thin sheet member including a fluorine resin such as polytetrafluoroethylene (PTFE) or the like having high heat resistance and a low coefficient of friction.

Further, a felt member 627 is placed between one surface of the second pressurizing member 622 and the inner circumferential surface of the pressurizing belt 620 (see FIG. 3). Silicone oil for lubrication is impregnated in the felt member 627 and an increase in rotation resistance of the pressurizing belt 620 is suppressed by supplying the silicone oil on the inner circumferential surface of the pressurizing belt 620 while being in contact with the inner circumferential surface of the pressurizing belt 620.

Furthermore, a holding member 628 made of a synthetic resin having heat resistance, which holds the inner circumferential surface of the pressurizing belt 620 in a region besides the fixing region N of the pressurizing belt 620, is placed on the side of the inner circumferential surface of the pressurizing belt 620 by being open to the side of the heating roller 610 (see FIGS. 3 and 4A). Plural rib portions 628*a* (not illustrated) are formed on an outer circumferential surface of the holding member 628 facing the inner circumferential surface of the pressurizing belt 620 along the rotation direction of the pressurizing belt 620, and the increase in the rotation resistance is suppressed by being in contact with the pressurizing belt 620.

(2.4) Support Module

As illustrated in FIG. 5, the support module 63 includes a heating roller support member 630, a pair of first swing members 631 and a pair of second swing members 632. The heating module 61 is supported on the heating roller support member 630 and the pressurizing module 62 is supported on the second swing members 632. Then, the heating module 61 and the pressurizing module 62 are in pressure contact with or separate from each other by swinging the second swing members 632 through the first swing members 631. The state of pressure contact between the heating module 61 and the pressurizing module 62 is released by the operation lever 62A.

The heating roller support member 630 includes a pair of side plates 630A which are provided on the both end sides of the heating roller 610, respectively and a connection plate 630B that is provided along an axial direction of the heating roller 610 and connects the pair of side plates 630A.

A support shaft 630Aa protruding inwardly is formed in the side plate 630A and swingably supports the first swing member 631 described below. Further, a post mount portion 630Ab on which a post 633 is mounted through which a pressurizing spring S is inserted through the first swing member 631 is formed in the side plate 630A.

The heating roller 610 is rotatably supported between the pair of side plates 630A of the heating roller support member 630 having such a configuration through a bearing BR.

A support hole 631*a* is formed in the first swing member 631 and a support shaft 632*a* provided in the second swing member 632 is inserted into the support hole 631*a*, and the second swing member 632 is swingably mounted on the first swing member 631.

A shaft 62B passes through and is rotatably provided in the pair of first swing members 631, and a cam 62C is mounted on one end and the operation lever 62A is mounted on the other end of the shaft 62B.

A cylindrical member 632A is rotatably supported on outside of the second swing member 632 and a circumferential surface thereof comes into contact with the cam 62C.

The pressurizing module 62 is mounted on the second swing member 632 of the support module 63 having such a configuration through the pair of belt guide members 624.

As a result, the operation lever 62A is rotatably operated so that a contact position between the cam 62C and the cylindrical member 632A is changed, the second swing member 632 swings about the support shaft 632*a* with respect to the first swing member 631, and the pressurizing module 62 supported on the second swing member 632 performs pressure contact with or separation from the heating module 61 (see FIGS. 2 and 3).

(3) Configuration and Operation of Second Pressurizing Member

Figure 6B:
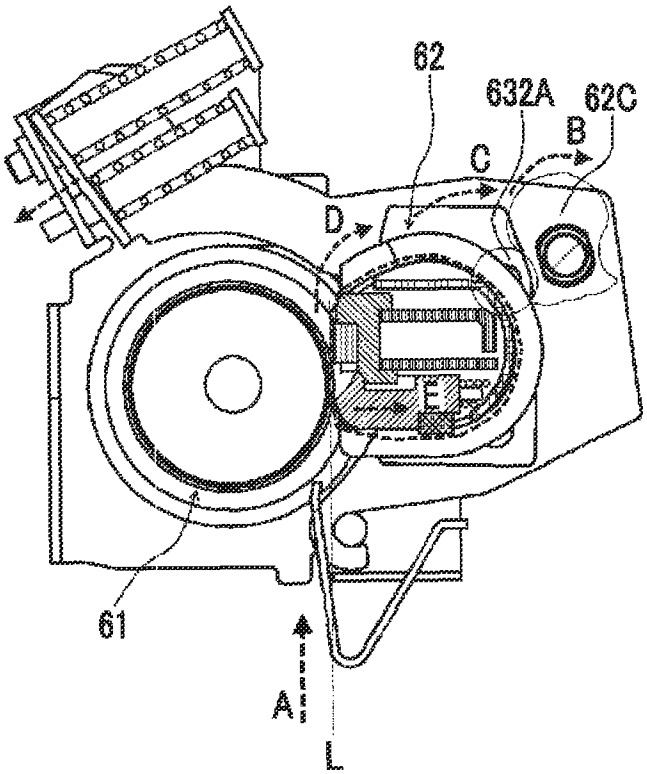
FIG. 6B is a sectional schematic diagram of the pressurizing module and the heating roller of a state (a jammed paper removing mode) where pressure contact is released when paper clogging occurs.
Figure 6A:
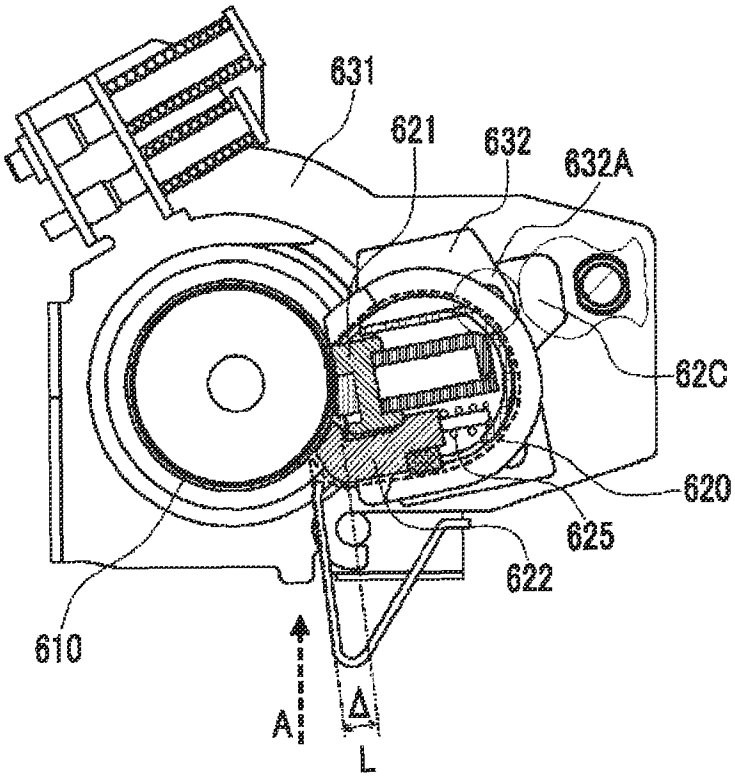
FIG. 6A is a sectional schematic diagram of a pressurizing module and a heating roller of a state (a normal fixing mode) where a fixing operation is performed.

FIG. 6A is a sectional schematic diagram of the pressurizing module 62 and the heating roller 610 in a state where (a normal fixing mode) the fixing operation is performed and FIG. 6B is a sectional schematic diagram of the pressurizing module 62 and the heating roller 610 in a state where (a jammed paper removing mode) the pressure contact is released when paper clogging occurs.

Hereinafter, a configuration and an operation of the second pressurizing member 622 in the pressurizing module 62 are described with reference to the drawings.

(3.1) Normal Fixing Mode

In the pressurizing module 62, the both end portions 622*a* of the second pressurizing member 622 are inserted through sliding portions 6243*a* of the through holes 6243 formed in the belt guide member 624 (see FIGS. 4A and 4B) on the upstream side in a transportation direction A of the sheet in the fixing region N.

Then, the both end portions 622*a* are biased to the side of the heating roller 610 by the coil spring 625 placed in a spring holding portion 6243*b* of the through hole 6243 and a top portion 622*b* guides the sheet P by protruding from the side of the inner circumferential surface of the pressurizing belt 620 to the side of the outer circumferential surface of the heating roller 610 so that the sheet P is in contact with the heating roller 610 on the upstream side from the fixing nip portion in the transportation direction of the sheet.

On the downstream side of the fixing region N in the transportation direction of the sheet, the first pressurizing member 621 and the pad member 623 form the downstream side of the fixing region N by pressing the outer circumferential surface of the heating roller 610 through the pressurizing belt 620.

As a result, in the normal fixing mode, a region that is formed by the outer circumferential surface of the pressurizing belt 620 supported by the second pressurizing member 622 along the transportation direction of the sheet P and the fixing nip portion that is formed by the outer circumferential surface of the pressurizing belt 620 that is pressurized by the pad member 623 and the first pressurizing member 621 continuously form the fixing region N.

Then, for a tangential line L that is virtual in the transportation direction A of the sheet in the fixing region N, the outer circumferential surface of the heating roller 610 is not in contact with the tangential line L in an arc shape on the upstream side of the fixing region N, but the second pressurizing member 622 protrudes from the tangential line L by supporting the pressurizing belt 620 from the side of the inner circumferential surface thereof (Δ in FIG. 6A).

As a result, when the sheet P is transported and delivered into the fixing region N, the sheet P is heated in the fixing region N formed by the second pressurizing member 622 before the sheet P is transported to the fixing nip portion that is pressurized by the pad member 623 and the first pressurizing member 621 so that fixing performance is improved (FIG. 6A).

(3.2) Jammed Paper Removing Mode

When paper clogging occurs and the sheet P is interposed and remains in the fixing region N of the fixing device 60, a user rotates the operation lever 62A and the pressure contact between the pressurizing module 62 and the heating module 61 is released (FIG. 6B).

As illustrated in FIG. 6B, first, when the operation lever 62A is rotated, the cam 62C mounted on the one end side of the shaft 62B rotates (arrow B) and a contact position with the cylindrical member 632A that is rotatably supported on the second swing member 632 changes, and the second swing member 632 enters a state of being capable of rotating in an arrow C direction. As a result, a pressurizing state of the pressurizing spring S which presses the second swing member 632 to the side of the heating roller 610 through the first swing member 631 is released.

As a result, the second swing member 632 supporting the pressurizing module 62 rotates in the arrow B direction and, at the same time, the pressurizing module 62 rotates in an arrow D direction in a state of being in contact with the outer circumferential surface of the heating roller 610 in the fixing region N.

According to the rotation of the pressurizing module 62, the top portion 622*b* of the second pressurizing member 622 protruding to the side of the outer circumferential surface of the heating roller 610 through the pressurizing belt 620 comes into contact with the outer circumferential surface of the heating roller 610, but the both end portions 622*a* of the second pressurizing member 622 is movably supported with respect to the outer circumferential surface of the heating roller 610 by being inserted into the through hole 6243 formed in the belt guide member 624.

Therefore, the second pressurizing member 622 that comes into contact with the outer circumferential surface of the heating roller 610 may be moved on the inside of the through hole 6243 formed in the belt guide member 624 by a contact pressure thereof in a direction (arrow E in FIG. 6B) opposite to the direction in which the second pressurizing member 622 presses the pressurizing belt 620.

As a result, the pressurizing module 62 rotates in a state of being in contact with the outer circumferential surface of the heating roller 610 in the fixing region N and the pressure contact is released, and it enters a state where the jammed paper interposed in the fixing region N may be removed.

As described above, in the fixing unit 600 configuring the fixing device 60 according to the exemplary embodiment, the second pressurizing member 622 is biased by the coil spring 625 and is movably supported in the direction facing the outer circumferential surface of the heating roller 610.

Thus, in the normal fixing mode, from the upstream side in the transportation direction of the sheet P, the outer circumferential surface of the pressurizing belt 620 that is supported on the second pressurizing member 622 and the outer circumferential surface of the pressurizing belt 620 that is pressurized by the pad member 623 and the first pressurizing member 621 continuously form the fixing region N along the transportation direction of the sheet P so that it is possible to improve the fixing performance.

Then, in the jammed paper removing mode, the second pressurizing member 622 moves in the direction opposite to the direction in which the second pressurizing member 622 presses the pressurizing belt 620 with the contact pressure to the heating roller 610 and the pressurizing module 62 is released from the pressure contact, and it enters a state where the jammed paper interposed in the fixing region N may be removed.

The foregoing has described the exemplary embodiment according to the invention, but the invention is not limited to the exemplary embodiment, and modifications may be made in various ways within the scope of the invention described in the claims. For example, the image forming apparatus 1 according to the exemplary embodiment is described for the intermediate image transfer type image forming apparatus including the intermediate image transfer belt 51, but may be a direct image transfer type image forming apparatus that directly transfers the toner image held in the photoconductor drum 31 to the recording medium.

Further, it is also possible to apply to a monochrome image forming apparatus in addition to the color image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating rotating body that heats a toner image formed on a recording medium;

a pressurizing rotating body including:

an endless belt that is placed in such a manner that an outer circumferential surface thereof faces the heating rotating body;

a first pressurizing member that is placed on a side of an inner circumferential surface of the endless belt and forms a fixing nip portion between the endless belt and the heating rotating body by pressing the outer circumferential surface of the endless belt to the heating rotating body; and a second pressurizing member that guides the recording medium so that the recording medium comes into contact with the heating rotating body on an upstream side in a transportation direction of the recording medium of the fixing nip portion by pressing the endless belt to the heating rotating body on the upstream side of the fixing nip portion of the side of the inner circumferential surface of the endless belt in the transportation direction of the recording medium; and a releasing unit that releases pressure contact of the pressurizing rotating body that is in pressure contact with the heating rotating body, wherein the second pressurizing member is configure to move in a direction opposite to a direction in which the second pressurizing member is pressed toward the pressurizing rotating body when the pressure contact of the pressurizing rotating body is released by the releasing unit, wherein the first pressurizing member and the second pressurizing member are movable independent of one another.

2. The fixing device according to claim 1, wherein the releasing unit releases the pressure contact of the pressurizing rotating body that is in pressure contact with the heating rotating body by rotating the pressurizing rotating body to a downstream side in the transportation direction of the recording medium.

3. An image forming apparatus comprising:

an image forming unit that forms a toner image on a recording medium; and the fixing device according to claim 1 that fixes the toner image on the recording medium by heating and pressurizing the toner image formed on the recording medium by the image forming unit.

4. The fixing device according to claim 1, wherein the first pressurizing member and the second pressurizing member are formed of a synthetic resin having heat resistance.

5. The fixing device according to claim 1, wherein the second pressurizing member is pressed toward the pressurizing rotating body by a spring member.

6. The fixing device according to claim 5, wherein the second pressuring member moves toward the spring member when the pressure contact of the pressurizing rotating body is released by the releasing unit.

7. A fixing device comprising:

a heating rotating body that heats a toner image formed on a recording medium;

a pressurizing rotating body including:

an endless belt that is placed in such a manner that an outer circumferential surface thereof faces the heating rotating body;

a first pressurizing member that is placed on a side of an inner circumferential surface of the endless belt and forms a fixing nip portion between the endless belt and the heating rotating body by pressing the outer circumferential surface of the endless belt to the heating rotating body; and a second pressurizing member that guides the recording medium so that the recording medium comes into contact with the heating rotating body on an upstream side in a transportation direction of the recording medium of the fixing nip portion by pressing the endless belt to the heating rotating body on the upstream side of the fixing nip portion of the side of the inner circumferential surface of the endless belt in the transportation direction of the recording medium; and a releasing unit that releases pressure contact of the pressurizing rotating body that is in pressure contact with the heating rotating body; and a belt guide member that rotatably supports the inner circumferential surface of the endless belt by fitting on an inside of both end portions of the endless belt, wherein the second pressurizing member is configure to move in a direction opposite to a direction in which the second pressurizing member is pressed toward the pressurizing rotating body when the pressure contact of the pressurizing rotating body is released by the releasing unit, and wherein the second pressurizing member is movably held on the belt guide member by being biased at the both end portions with an elastomer.

8. The fixing device according to claim 7, wherein the releasing unit releases the pressure contact of the pressurizing rotating body that is in pressure contact with the heating rotating body by rotating the pressurizing rotating body to a downstream side in the transportation direction of the recording medium.

9. An image forming apparatus comprising:

an image forming unit that forms a toner image on a recording medium; and the fixing device according to claim 7 that fixes the toner image on the recording medium by heating and pressurizing the toner image formed on the recording medium by the image forming unit.

* * * * *